US005352172A

United States Patent [19]

Suzaki

[11] Patent Number: 5,352,172

[45] Date of Patent: Oct. 4, 1994

[54] ROPE EXERCISER

[76] Inventor: Kiyoshi Suzaki, 1137 El Medio Ave., Pacific Palisades, Calif. 90272

[21] Appl. No.: 143,911

[22] Filed: Oct. 25, 1993

[51] Int. Cl.[5] ..... A63B 21/018

[52] U.S. Cl. ..... 482/120; 482/114; 182/5; 182/191

[58] Field of Search ..... 482/114, 120, 139; 182/5, 191; 24/129 A, 130

[56] References Cited

U.S. PATENT DOCUMENTS

| | | | |
|---|---|---|---|
| 507,455 | 10/1893 | Sansoucy | 182/191 |
| 3,197,204 | 7/1965 | Holkesvick . | |
| 3,411,776 | 11/1968 | Holkesvick . | |
| 3,462,142 | 8/1969 | Sterndale . | |
| 3,532,189 | 10/1970 | Wade | 482/120 |
| 3,591,174 | 7/1971 | Silberman . | |
| 3,608,900 | 9/1971 | Welch . | |
| 3,614,098 | 9/1971 | Carr . | |
| 3,656,745 | 4/1972 | Holesvick . | |
| 3,717,339 | 2/1973 | Holesvick . | |
| 4,027,876 | 6/1977 | Johnston . | |
| 4,311,218 | 1/1982 | Steffen | 182/5 |
| 4,343,466 | 8/1982 | Evans . | |
| 4,560,160 | 12/1985 | Smith . | |
| 5,193,252 | 3/1993 | Svehaug | 24/130 |

*Primary Examiner*—Richard J. Apley
*Assistant Examiner*—Lynne A. Reichard
*Attorney, Agent, or Firm*—Arthur Freilich; Robert D. Hornbaker; Leon D. Rosen

[57] ABSTRACT

A rope friction exercise device is described which is in the form of a member 12 (FIG. 2) having multiple bars (51–62) about which a rope (30) can extend in multiple wrappings to provide frictional resistance against pulling of the rope. The member has an elongated longitudinally-extending first side (42) and has a first plurality of bars (51–54) spaced along the first side, with each bar having a first end (80) mounted on the side and a second end (74) which is free, so a rope can be wrapped and unwrapped from a bar by merely installing and removing it from the free end, to thereby change resistance to rope pulling. A plurality of parallel bars enables a rope section to extend over and under the bars in a small angle of wrap to enable a small change in rope pulled resistance, in an arrangement that makes it easy to understand how to change rope pulling resistance. A handle 36 (FIG. 6) allows easy adjustment of rope length.

10 Claims, 2 Drawing Sheets

FIG. 1
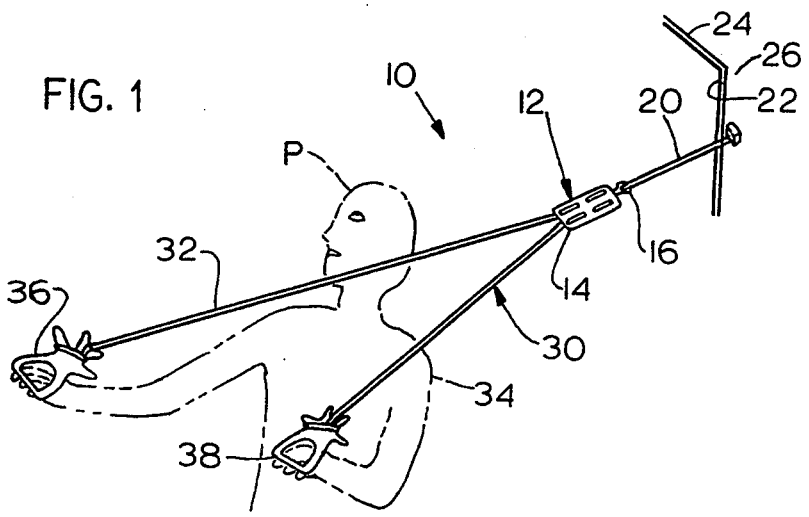
FIG. 2
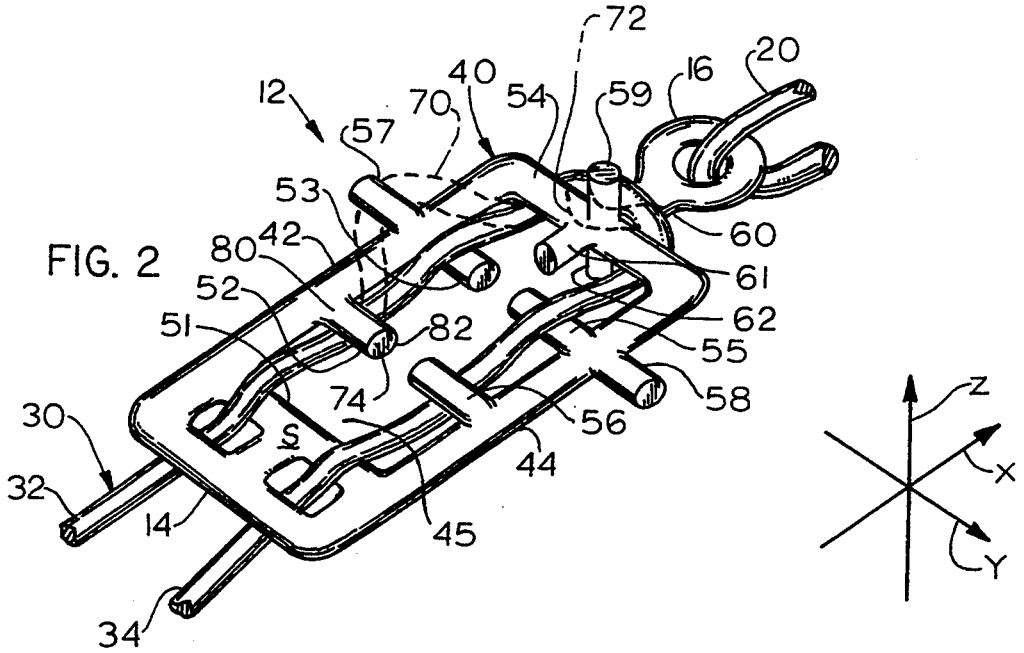
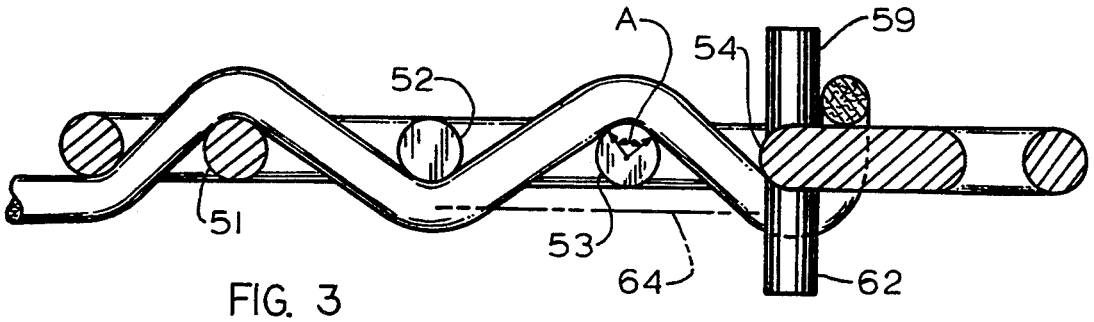
FIG. 3

FIG. 5
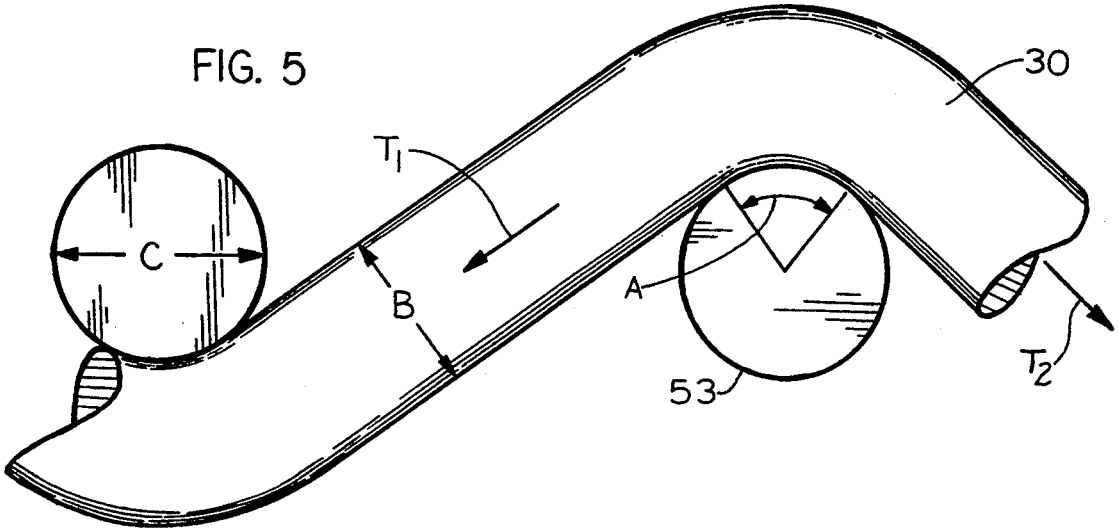
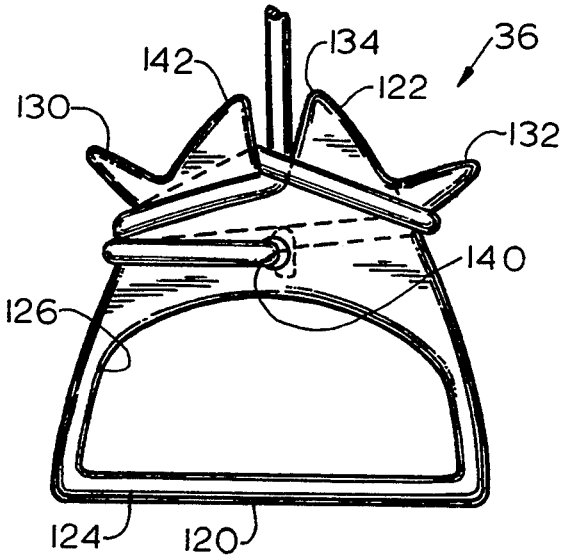
FIG. 6
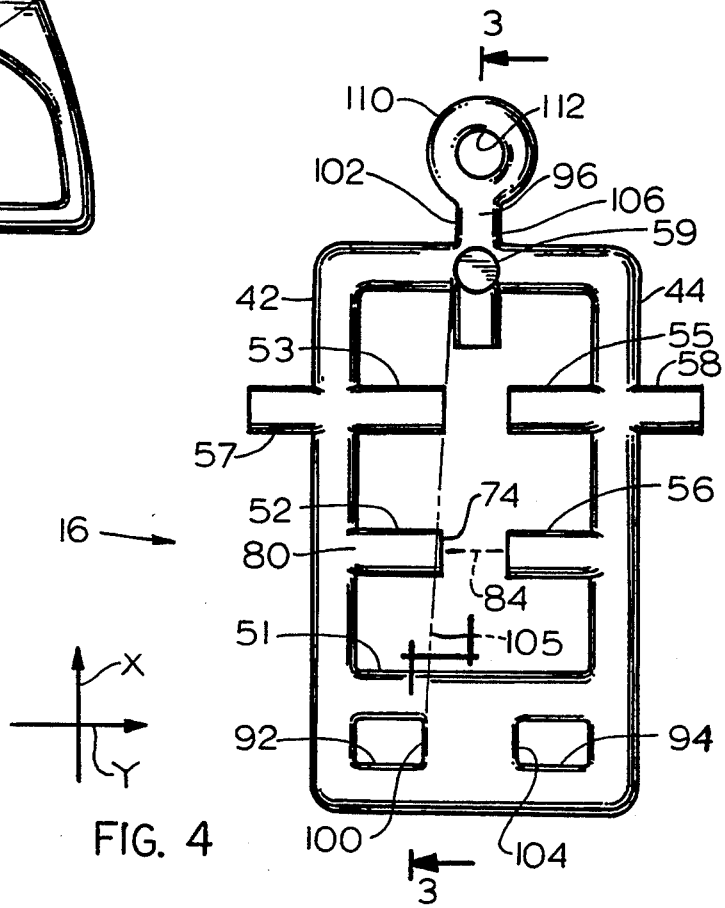
FIG. 4

ROPE EXERCISER

BACKGROUND OF THE INVENTION:

One form of exercise involves moving a limb such as an arm, against high resistance. A small and low cost device has one or more rods about which the middle of a rope can be wrapped, to provide resistance to pulling of each end of the rope away from the device. U.S. Pat. Nos. 3,510,132 by Holkesvick and 4,343,466 by Evans describe devices of this type. The devices described in these patents include a pair of largely parallel rods, and the rope is wound by different numbers of complete helical turns around the rods, lo and in a partial turn about a stud, to vary resistance to pulling of the rope. Since the amount of wrap varies by increments of 360°, except for wrap about a single stud, the variation in rope tension varies in large increments. Also, to change the resistance to rope pulling, a person must thread the end of the rope between the rods to add or subtract a rope turn, which is very inconvenient. A rope friction exercise device which enabled variation of rope friction in small increments and which enabled variation of resistance with only minimal inconvenience, would be of value.

SUMMARY OF THE INVENTION

In accordance with one embodiment of the present invention, a rope friction exercise device is provided which facilitates varying of frictional resistance and which enables frictional resistance to be varied in small increments. The exercise device includes a member having a frame with a side extending in a longitudinal direction and a plurality of bars longitudinally spaced along the first side. Each bar has a first end mounted on the frame side and has an opposite second free end. A rope extends around different rods, with the friction of the rope increasing as the number of wraps and the angle of each wrap increases. A wrap about a particular rod can be removed or installed by sliding the rope off or on to the free end of the rod. A first plurality of rods that are spaced along the first side, project in generally the same direction from the first side, so that a rope wrapped progressively over and under succeeding rods undergoes only a small change in friction when one wrap is added or removed.

A handle is provided which a person can grasp by hand or foot to pull one end of the rope. The handle has an outer end which can be grasped by the person and has an inner end about which the rope can be wrapped in different amounts to vary the effective length of the rope.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view of the exercise device member of the present invention, showing a rope wrapped about it, with the ends of the rope attached to handles of the present invention, and indicating a person holding the handles to exercise.

FIG. 2 is a more detailed isometric view of the member of FIG. 1, showing a portion of the rope installed thereon in a first configuration and indicating in phantom lines parts of two other rope wrap configurations.

FIG. 3 is a partial sectional view of the member and rope of FIG. 2, taken on the line 3—3 of FIG. 4.

FIG. 4 is a plan view of the member of FIG. 2, without the rope thereon.

FIG. 5 is an enlarged diagrammatic view of a portion of the member and rope of FIG. 3.

FIG. 6 is a plan view of one of the handles of the system of FIG. 1, and showing a portion of a rope wrapped thereon.

DESCRIPTION OF THE PREFERRED EMBODIMENT

FIG. 1 illustrates a system 10 for use by a person P in exercising. The system includes a rope friction exercise device or exercise member 12 which has opposite ends 14, 16. One end 16 is mounted, as through a cord 20 to a mount location such as the space 22 between the hinge end of a door 24 and the door jamb 26. A rope 30 extends to and from the other end 14. The purpose of the exercise member 12 is to provide friction against pulling of either end portion 32, 34 of the rope. The person P grasps handles 36, 38 (by hand or foot) that are attached to the ends of the rope, and exercises by first pulling one handle 36 against the frictional resistance provided by the exercise member 12, and then pulling the other handle 38 against frictional resistance.

As shown in FIG. 2, the exercise member 12 includes a frame 40 having first and second opposite sides 42, 44 with a space 45 between them, and having opposite ends 14, 16. A plurality of bars 51–62 are mounted on the frame, and the rope 30 can be wrapped in a variety of configurations around the bars. The frame sides 42, 44 extend substantially along a longitudinal direction X. Most of the bars 51–62 extend perpendicular to the longitudinal direction, with a group of the bars 51–58 extending substantially in a lateral direction Y, and with two of the bars 59, 62 extending in a transverse direction Z which is perpendicular to the other two directions X, Y. Two bars 60,61 extend along the longitudinal direction X. For the relatively simple rope configuration shown in solid lines in FIG. 2, the rope extends primarily in undulating paths, over and under bars 51, 52, 53, and 54, in a loop around longitudinally-extending bar 59 or around bar 60 and/or 61, 62, so the rope extends in the opposite direction, and in an undulating path around bars 54, 55, 56, and 51. As shown in FIG. 3, which shows half of the undulating path, the rope is wrapped by only a moderate angle A about each of the first plurality of bars 51–54 with the wrap about the bar 54 being somewhat greater than for the others. A "wrapping" is a length of tensioned rope that changes direction (generally by a plurality of 10's of degrees) by contact with another object, or is the step of changing its direction by such contact. About 2A of wrapping can be eliminated by removing the rope from around one of the rods such as 53 and letting it extend along the path portion indicated at 64. The change in rope friction resulting from eliminating 2A of wrap, is only moderate, due to the fact that there is only a moderate angle of wrap A around each of the bars of the first plurality of bars, for the rope configuration shown. By contrast, prior art rope friction exercise devices have provided for only large changes in rope friction.

FIG. 5 is an enlarged and simplified view of a portion of the system of FIG. 3. It can be seen that the bars 53 have rounded surfaces about which the rope 30 wraps, rather than sharply angled corners. In FIG. 5, the diameter B of the rope is three-quarters of the diameter C of each bar, and the gap between adjacent bars is twice the diameter C of each bar. In this situation, the wrap angle A is about 75°. This wrap angle A is about 20% of a full turn (of 360°) and is about 40% of a half turn (180°). The frictional resistance to pulling of a rope caused by a wrap around a rod can be expressed as the percentage increase of tension $T_1$-$T_2$/$T_1$ due to the rope passing around the wrap angle A. As the wrap angle A increases, the percentage increase in tension increases at a faster rate than the angle. For example, it may be assumed that the rope 32 is hemp and the rods 53 are of iron, so that the coefficient of sliding friction f is about 0.2. In that case, the percentage increase in tension is 29% for a wrap angle of 75°, is 87% for a wrap angle of 180°, and is 250% for a wrap angle of 360°. If the only steps of friction increase are due to an increase or decrease of a complete (360°) wrap, then it will be difficult to produce small changes in rope pulling resistance.

The actual formula for calculating the differential tension $T_1$-$T_2$ is given by the following well-known equation:

$$T_1\text{-}T_2=(e^{fa}\text{-}1)T_2 \qquad \text{(Eq. 1)}$$

Where e=2.71 8+, f is the coefficient of sliding friction, and a is the angle of contact or wrap (in radian).

By applicants provision of a first plurality of rods (51–54) all extending largely in the same direction, applicant is able to extend a rope in an undulating path that results in less than 180° wrap of the rope about each of a plurality of bars. The first plurality of bars 51–54 all extend much less than 180° (i.e. less than 160°) from each other away from the first side of the frame, more preferably less than 90° away from each other, even more preferably less than 45° away from each other, and most preferably parallel to each other. The wrap angle A is preferably no more than 120°. Where the rope diameter B is three quarters of the bar diameter C, a wrap angle of about 120° is achieved at a bar spacing gap equal to the bar diameter C, and the wrap angle is very sensitive to rope thickness and bar spacing.

It is noted that in FIG. 2, applicant shows, in phantom lines, a rope section 70 extending between two rods 52, 54 of the first plurality of rods, by means of a wrap around the rod 57 which extends 180° from the first rods 51–54, with respect to the first side 42 of the frame. The rope section 70 undergoes two wraps of about 120° about the first side 42 of the frame and an additional wrap of about 120° about the rod 57. Thus, extending the rope around the rod 57 as shown at 70, results in a large increase of rope resistance to pulling. In a similar manner, applicant indicates at 72, a rope section which has been wrapped about the transverse rod 59. This wrapping results in an additional wrap of about 160° about the rod 59, and increases wrap about rod 54. Other wrappings can be resorted to, such as by extending the rope section 72, so that it wraps about the longitudinally-extending bar 61. Each of the sides 42, 44 is in the form of a rod. The rods 42–44 and the bars 51–62 can each be of largely cylindrical cross-section, with smooth rope-wrap surfaces S to avoid damage to the rope and to provide a constant pull resistance.

Applicant allows a person to easily adjust the resistance to rope pulling, by forming many of the bars 52–53, 55–59, 61 and 62 with free ends 74. Each rod has a first location or end 80 which is fixed to the frame 40, with most of the rods having an opposite second end 74 which is free, in that it is not attached to the frame or any other rod and in that there is a gap 82 or open space around the free end through which a rope can be moved without unthreading the rope through the entire exercise member. When pairs of bars such as 52, 56 have coincident axes 84, the pair of bars may be considered to consist of a single bar with a gap 82 in it.

When a person exercises and decides to increase or decrease the rope resistance, he can do this by unwrapping a rope section from one of the bars and/or wrapping a rope section about another bar or in a different configuration. Such unwrapping and wrapping is accomplished without having to detach an end of the rope from a handle, door, etc. and pull the rope so its end can be threaded around and through parts of the member. Thus, applicant's use of some bars with free ends, results in much greater ease in changing of rope pulling resistance.

The particular member 12 which is also shown in FIG. 4, has a pair of first guides 92, 94 at its first end, and has a second guide 96 at its second end. The guides 92, 96 have right side limiting walls 100, 102 that are connected by an imaginary line 105 extending primarily longitudinally, which limit rightward movement of the rope extending around bars 52, 53, to prevent the rope from falling off these bars. The imaginary line 105 lies closer to the bar free ends 74 than to the bar first or captured ends 80. Similarly, the guides 94, 96 have left side limit walls 104, 106 that prevent the rope portion extending past the rods 55, 56 from falling off these rods at their free ends 74. In practice, the exercise member 12 aligns itself with the rope ends, so even if guides 92, 94 are connected (no limiting walls 100, 104) the rope does not tend to fall off a bar when the rope is under tension. The guide 92, 96 and limiting walls 100, 102 are useful primarily to position the rope when the rope is not under tension. The guide 96 lies between imaginary extensions of the sides 42, 44. It is noted that the transverse bar 59 can serve as such a guide. The member has a mount 110 at its first end, which can receive a rope to mount the first end. A rope or web extending around the eyelet 112 of the mount can attach to a hook, a block that lies on the other side of the space between a door and door jamb, etc.

The member 16 can be constructed as a unitary piece, as by welding, casting, or molding, with casting and molding enabling construction of a strong member at moderate cost.

FIG. 6 illustrates details of one of the handles 36, the particular handle enabling adjustment of the total effective rope length. The handle has outer and inner ends 120, 122, with the outer end forming a bar 124 that can be grasped by a person's limb, that is, his hand or foot, and forming an opening 126. The inner end of the handle includes a pair of at least partially laterally extending projections 130, 132. A slot 134 is formed at the middle of the inner end, with the slot being open at the inner end. A rope can be initially projected through a hole 140 formed in the handle, with a knot tied at the extreme end of the rope to prevent it from passing through the hole. The rope can be wrapped as shown, between the projections 130, 132, by way of the slot 134. The rope can be lengthened by loosening the rope and unwrapping it from one of the projections such as 130 and the corresponding side 142 of the handle inner end, and can be shortened in the reverse manner. The handle can be plate-like, with a constant thickness.

It should be noted that while a traditional hemp, nylon, or other woven rope can be used, that other flexible elongated members such as wire ropes can be used, any such elongated flexible member being herein referred to as a rope. It also may be noted that the bars can be tapered along their length to position the rope wrapped thereon, can have a cross-section other than circular, and may be rotatably mounted.

Thus, the invention provides a rope exercise member that provides friction to the pulling of a rope therethrough, as well as a handle that can be mounted at the end of the rope. The exercise member includes multiple bars about which the rope can be wrapped in multiple wrappings, with at least some of the bars having free ends to facilitate wrapping and unwrapping about the bar without having to unthread and rethread the rope through the member or undo and remount the cord from the door. A plurality of bars extend largely in the same direction from a first side of the frame of the member, so that the rope can be wrapped at only a moderate wrap angle about each bars to enable small increments of change of resistance to rope pulling. A handle can be provided which has projections at opposite sides of its inner end, to enable the rope end portion to be shortened and lengthen by wrapping or unwrapping the rope about the handle projections.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An exercise device having surface regions about which a rope can be wrapped in a plurality of wrappings to slide thereon, so as to provide frictional resistance to pulling of the rope, comprising:

a member having a frame with a first side extending primarily along a longitudinal direction, and having a first plurality of bars permanently fixed in position and orientation on said frame first side and spaced apart along said longitudinal direction, with each bar extending primarily perpendicular to said longitudinal direction and having a rope-wrap surface, with said rope-wrap surfaces being curved rather than forming sharp corners, so a rope can slide along said rope-wrap surfaces without damage;

said bars each having a first end mounted on said frame first side and an opposite second end, with said second ends being free and being devoid of any barriers at said free ends, so a rope can be wrapped and unwrapped about one of said bars by moving a middle portion of a rope onto and off the bar free end, without disassembling said device.

2. The exercise device described in claim 1 wherein:

said frame has first and second guides spaced apart primarily along said longitudinal direction, with said first plurality of bars lying between said first and second guides, said guides each having a portion that prevents the rope from slipping off said free ends of said bars;

said bars have smooth rope wrap surfaces lying between said guides, and said bars are devoid of grooves in or adjacent to said rope wrap surfaces.

3. The exercise device described in claim 1 wherein: said member is rigid.

4. The exercise device described in claim 1 wherein:

said frame has an elongated longitudinally-extending second side which is laterally spaced from said first side, with said first and second sides each having a pair of longitudinally-spaced opposite ends;

said first plurality of bars are located with their first ends mounted at longitudinally-spaced locations on said first side and with said bars extending therefrom in a direction primarily toward said second side;

said member having a plurality of second bars each having a first end mounted on said second side and extending therefrom in a direction primarily toward said first side and having a free end;

a first pair of guides at said opposite ends of said first side which are positioned to keep a rope from sliding off the free ends of said first bars;

a second pair of guides at said opposite ends of said second side which are positioned to keep a rope from sliding off the free ends of said second bars.

5. The exercise device described in claim 4, including:

at least one rod extending largely perpendicular to said bars;

a rope which extends past one of said guides at said first end of said first side to one of said guides at said second end of said first side, and in a loop around said at least one rod, and past one of said guides at said second end of said second side, and past one of said guides at said first end of said second side.

6. The exercise device descried in claim 1 wherein:

said frame has a longitudinally extending second side which is laterally spaced from said first side, and including a laterally extending rod that connects said opposite sides;

said first bars extend in a predetermined lateral direction from said frame first side, and said member includes a transverse bar which projects from said rod in a direction which is substantially perpendicular to said predetermined lateral direction and to said longitudinal direction.

7. An exercise device which can be used with a rope to exercise the human body, comprising:

a frame which has a pair of elongated largely parallel opposite sides each extending primarily in a longitudinal direction, with a space between said opposite sides, said frame having first and second longitudinally-spaced opposite ends connected to said sides, and said frame having a first plurality of bars each having a mounted bar location fixed in position and orientation on one of said sides and each extending largely perpendicular to said longitudinal direction, with said bars having free ends opposite said mounted bar locations, with said bars having largely circular crosssections to provide rounded surfaces around which the rope can extend.

8. The exercise device described in claim 7 wherein:

a first bar of said of bars has a bar location mounted on said frame first side and extends in a first direction therefrom, and including a rod mounted on said frame and extending largely perpendicular to said first direction.

9. The exercise device described in claim 7 including:

at least one rod extending largely perpendicular to said bars;

said frame includes first and second pairs of guides at said opposite ends; and including a rope which extends between said first pair of guides and in a loop around said rod and between said second guides, said rope extending in an undulating path around said bars with said rope extending over one of said bars and under another of said bars when said bars extend largely horizontally, and with the space between said bars through which said rope extends, being empty.

10. The exercise device described in claim 9 including:

a plurality of second bars that each has a second bar location fixed to said second side and a free end, with said second plurality of bars extending from said second side toward said first side;

a rod mounted on said first end and extending primarily perpendicular to said lateral directions;

said rope extends in said loop around said rod.

* * * * *